US007000754B2

(12) United States Patent
Baudat et al.

(10) Patent No.: US 7,000,754 B2
(45) Date of Patent: Feb. 21, 2006

(54) CURRENCY VALIDATOR

(75) Inventors: Gaston Baudat, Exton, PA (US); Fatiha Anouar, Exton, PA (US)

(73) Assignee: Mars Incorporated, McLean, VA (US)

( * ) Notice: Subject to any disclaimer, the term of this patent is extended or adjusted under 35 U.S.C. 154(b) by 163 days.

(21) Appl. No.: 10/441,809

(22) Filed: May 20, 2003

(65) Prior Publication Data

US 2003/0217906 A1 Nov. 27, 2003

(30) Foreign Application Priority Data

May 22, 2002 (EP) ..... 02253587

(51) Int. Cl.
*G07D 7/00* (2006.01)

(52) U.S. Cl. ..... 194/207

(58) Field of Classification Search ..... 194/207, 194/206, 205, 302
See application file for complete search history.

(56) References Cited

U.S. PATENT DOCUMENTS 5,392,364 A * 2/1995 Yokoyama et al. ..... 382/190
5,503,262 A 4/1996 Baudat et al. ..... 194/206
5,931,277 A * 8/1999 Allan et al. ..... 194/317

FOREIGN PATENT DOCUMENTS

| | | |
|---|---|---|
| EP | 0 294 497 A1 | 12/1988 |
| EP | 0 924 658 A2 | 6/1999 |
| GB | 2 254 949 A | 10/1992 |

* cited by examiner

*Primary Examiner*—Donald P. Walsh
*Assistant Examiner*—Mark J. Beauchaine
(74) *Attorney, Agent, or Firm*—Fish & Richardson P.C.

(57) ABSTRACT

A method of classifying an item of currency using a currency tester comprises sensing variable characteristics of a currency item and deriving a data vector (X) using values of the sensed characteristics, and transforming the data vector so that the variables represented by at least first and second sets of components (Y1, Y2) of the transformed vector are substantially independent, so that the mahalanobis distance of X is substantially equivalent to the sum of the mahalanobis distances of the components (Y1, Y2), and calculating a mahalanobis distance in at least two parts using said first and second sets of components.

29 Claims, 3 Drawing Sheets

CURRENCY VALIDATOR

The invention relates to a currency validator and a method of classifying currency items.

In this specification the term currency is used to mean coins, banknotes, and other similar items of value such as value sheets and coupons. Except where specifically stated otherwise, it covers genuine and forged currency items.

Known currency validators operate by measuring certain characteristics of currency items using sensors, and then using the measured values to classify the currency item, that is, to determine whether or not the currency item is an example of a known target denomination or forgery. Various methods of classifying currency items are known including, for example, comparing a n-dimensional vector derived from n measurements of a currency item with a region defining valid examples of a target denomination in n-dimensional space. An example of a specific method of classifying currency involves using the mahalanobis distance, and comparing the mahalanobis distance with a threshold, which essentially defines an ellipse around the known population for each denomination.

The calculation of a mahalanobis distance involves using the mean and covariance matrix of the population distribution for each target denomination together with the n-dimensional vector derived from the measurements of a currency item.

Measurements are collected in the laboratory using samples of target denominations, and one or more sample validators. The target denominations may include known forgeries. The sample currency items are inserted into the sample validators and the measurements are used to derive a population distribution. The distribution is modelled statistically and the mean and covariance matrix is derived.

Product validators are programmed to calculate mahalanobis distances using the mean and covariance matrix values for each target denomination calculated as outlined above.

A problem with the prior art discussed above is that, especially when n is large, the amount of processing involved in calculating the mahalanobis distance can be large, which increases processing cost and time and the time involved in the classification.

Another problem is the variation in components, such as sensors, in the product validators and the resulting variations in measurements compared with the results obtained in the laboratory. It is known to make adaptations to take account of variations in each product but this can be time-consuming and increase costs. Another option to compensate for variations between products is to have a large acceptance threshold at the beginning of the product life, to achieve the best acceptance rate, but this is at the cost of an increased risk of accepting forgeries.

Aspects of the invention are set out in the accompanying claims.

An embodiment of the invention, and modifications, will be described with reference to the accompanying drawings of which:

FIG. 1 schematically illustrates an optical sensing device according to an embodiment of the invention, FIG. 2 schematically illustrates the power-delivery arrangement for a light source array used in the arrangement of FIG. 1;

DETAILED DESCRIPTION

The embodiment is a banknote validator. Broadly speaking, the banknote validator includes an optical sensing device having a pair of linear arrays of light sources, each array arranged above the transfer path of a banknote, for emitting light towards the banknote, and a detector in the form of a linear array of photodetectors arranged above the transfer path for sensing light reflected by the banknote. The light source arrays have a number of groups of light sources, each group generating light of a different wavelength. The groups of light sources are energised in succession to illuminate a banknote with a sequence of different wavelengths of light. The response of the banknote to the light of the different parts of the spectrum is sensed by the detector array. Because each of the photodetectors in the array receives light from a different area on the banknote, the spectral response of the different sensed parts of the banknote can be determined and processed for comparison with stored reference data to validate the banknote.

Basic components of the banknote validator of this embodiment are essentially as shown and described in WO 97/26626, and will be briefly described below.

Figure 1:
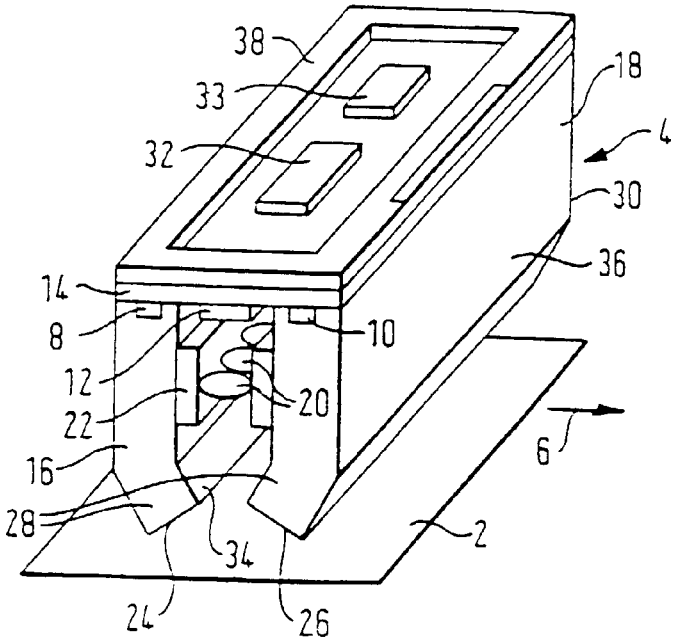

Referring to FIG. 1, in the validator, a banknote 2 is sensed by an optical sensing module 4 as it passes along a predetermined transport plane in the direction of arrow 6.

The sensing module 4 has two linear arrays of light sources 8, 10 and a linear array of photodetectors 12 directly mounted on the underside of a printed circuit board 14. A control unit 32 and first stage amplifiers 33 for each of the photodetectors are mounted directly on the upper surface of the printed circuit board 14.

Printed circuit board 14 is provided with a frame 38 made of a rigid material such as metal on the upper surface and around the peripheral edges of the board. The frame 38 is provided with a connector 40 whereby the control unit 32 communicates with other components (not shown) of the banknote validator, such as a position sensor, a banknote sorting mechanism, an external control unit and the like.

The optical sensing module 4 has two unitary light guides 16 and 18 for conveying light produced by source arrays 8 and 10 towards and onto a strip of the banknote 2. The light guides 16 and 18 are made from a moulded plexiglass material.

Each light guide consists of an upper vertical portion and a lower portion which is angled with respect to the upper portion. The angled lower portions of the light guides 16, 18 direct light that has been internally reflected with a light guide 16,18 towards an illuminated strip on the banknote 2 which is centrally located between the light guides 16 and 18.

Lenses 20 are mounted between the light guides in a linear array corresponding to the detector array 12. One lens 20 is provided per detector in the detector array 12. Each lens 20 delivers light collected from a discrete area on the banknote, larger than the effective area of a detector, to the corresponding detector. The lenses 20 are fixed in place by an optical support 22 located between the light guides 16 and 18.

The light-emitting ends 24 and 26 of the light guides 16 and 18, and the lenses 20, are arranged so that only diffusely-reflected light is transmitted to the detector array 12.

The source arrays 8 and 10, the detector array 12 and the linear lens array 20 extend across the width of the light guides 16 and 18, from one lateral side 28 to the other, so as to be able to sense the reflective characteristics of the banknote 2 across its entire width.

The light detector array 12 is made up of a linear array of a large number of, for example thirty, individual detectors, in the form of pin diodes, which each sense discrete parts of the banknote 2 located along the strip illuminated by the light guides 16 and 18. Adjacent detectors, supplied with diffusely reflected light by respective adjacent lenses 20, detect adjacent, and discrete areas of the banknote 2.

Figure 2:
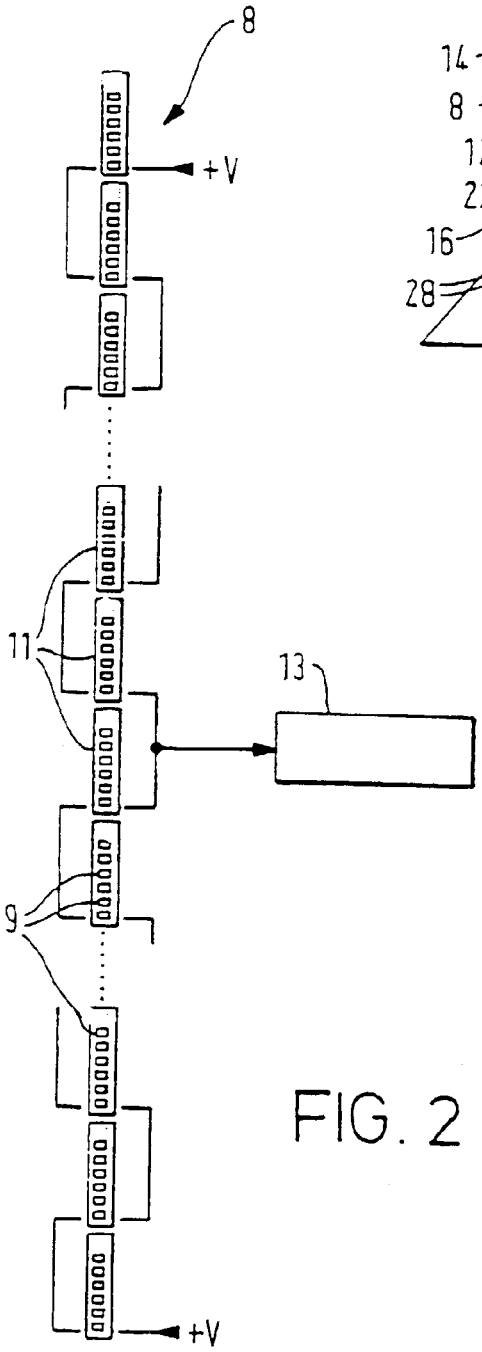

Reference is made to FIG. 2, which illustrates one of the source arrays 8 as mounted on the printed circuit board 14. The arrangement of the other source array 10 is identical.

The source array 8 consists of a large number of discrete sources 9, in the form of unencapsulated LEDs. The source array 8 is made up of a number of different groups of the light sources 9, each group generating light at a different peak wavelength. An example of such an arrangement is described in Swiss patent number 634411.

In this embodiment there are six such groups, consisting of four groups of sources generating light at four different infra-red wavelengths, and two groups of sources generating light at two different visible wavelengths (red and green). The wavelengths used are chosen with a view to obtain a great amount of sensitivity to banknote printing inks, hence to provide for a high degree of discrimination between different banknote types, and/or between genuine banknotes and other documents.

The sources of each colour group are dispersed throughout the linear source array 8. The sources 9 are arranged in the sets 11 of six sources, all sets 11 being aligned end-to-end to form a repetitive colour sequence spanning the source array 8.

Each colour group in the source array 8, is made up of two series of ten sources 9 connected in parallel to a current generator 13. Although only one current generator 13 is illustrated, seven such generators are therefore provided for the whole array 8. The colour groups are energised in sequence by a local sequencer in a control unit 32, which is mounted on the upper surface of printed circuit board 13. The sequential illumination of different colour groups of a source array is described in more detail in U.S. Pat. No. 5,304,813 and British patent application No. 1470737.

During banknote sensing all six colour groups are energised and detected in sequence during a detector illumination period for each detector in turn.

Thus, the detectors 12 effectively scan the diffuse reflectance characteristics at each of the six predetermined wavelengths of a series of pixels located across the entire width of the banknote 2 during a series of individual detector illumination periods. As the banknote is transported in the transport direction 6, an entire surface of the banknote 2 is sensed by repetitive scanning of strips of the banknote 2 at each of the six wavelengths. The outputs of the sensors are processed by the control unit 32 as described in more detail below.

Figure 3:
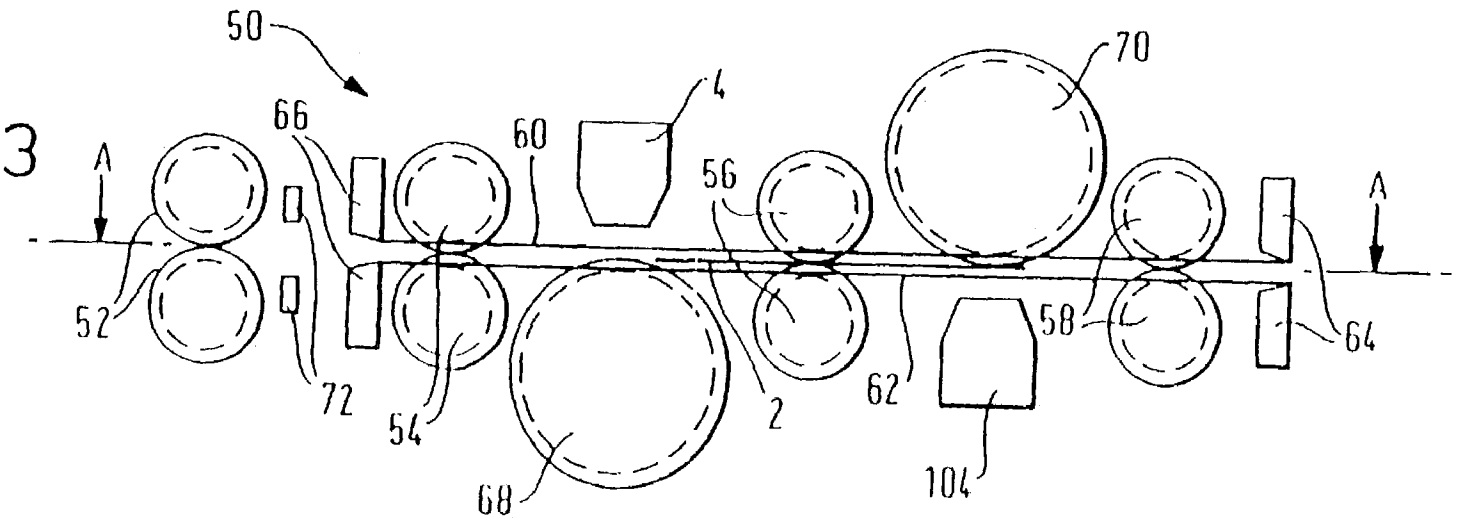
FIG. 3 shows a side view of components of a banknote validator.

The acquired data representative of the banknote is processed in control unit 32, as described in more detail below. By monitoring the position of the banknote during sensing with an optical position sensor located at the entrance to the transport mechanism used, predetermined areas of the banknote 2 which have optimum reflectance characteristics for evaluation are identified. Reference is now made to FIG. 3, which illustrates a banknote validator including optical sensing modules as illustrated in FIG. 1. Components already described in relation to FIG. 1 will be referred to by identical reference numerals.

FIG. 3 shows a banknote validator 50 similar to that described in International patent application No. WO 96/10808. The apparatus has an entrance defined by nip rollers 52, a transport path defined by further nip rollers 54, 56 and 58, upper wire screen 60 and lower wire screen 62, and an exit defined by frame members 64 to which the wire screens are attached at one end. Frame members 66 support the other end of the wire screens 60 and 62.

An upper sensing module 4 is located above the transport path to read the upper surface of the banknote 2, and a lower sensing module 104 is located, horizontally spaced from said upper sensing module 4 by nip rollers 56, below the transport path of the banknote 2 to read the lower surface of the banknote 2. Reference drums 68 and 70 are located opposedly to the sensing modules 4 and 104 respectively so as to provide reflective surfaces whereby the sensing devices 4 and 104 can be calibrated. Each of nip rollers 54, 56 and 58 and reference drums 68 and 70 are provided with regularly-spaced grooves accommodating upper and lower wire screens 60 and 62.

An edge detecting module 72, consisting of an elongate light source (consisting of an array of LEDs and diffusing means) located below the transport plane of the apparatus 50, a CCD array (with a self-focussing fibre-optic lens array) located above the transport plane and an associated processing unit, is located between entrance nip rollers 52 and the entrance wire supports 66.

In operation, a document is transported past sensing module 4 by means of the transport rollers 54. As the document is transported past the sensing module, light of the respective wavelength is emitted from each group of sources 9 in sequence, and light of each wavelength reflected from the banknote is sensed by each of the detectors, corresponding to a discrete area of the banknote.

Each group of sources is driven by a respective current generator 13 which is controlled by the control unit 32.

For each wavelength, light from the respective group of sources 9 is mixed in the optical mixer before being output towards the document. In that way, diffuse light is spread more uniformly across the whole width of the document. Light reflected from the document, which has been modified in accordance with the pattern on the document, is sensed by the detector array and the output signals are processed in the control unit 32.

Thus, for each position of the banknote under the optical sensing device, and for each sensor, corresponding to a pixel or measurement spot on the banknote, a set of six measurements are derived, corresponding to the six wavelengths of emitted light.

Next, the general principles underlying the invention will be described, followed by a description of a method of setting up a validator and then a method of validating a fed banknote.

A specific area of a banknote is pre-selected as a zone. The zone may be a specific linear, or 1-dimensional, region of a banknote, or a 2-dimensional region such as a square or a rectangle, or the whole banknote. The zone may be selected to correspond to a known security feature in a given banknote. Different zones may be selected for different denominations. A zone may be defined by a set of measurements spots for a set of wavelengths.

Measurements are taken from at least parts of a banknote including the specified zones using a banknote sensing device, for example, as described above, resulting in measurements for different wavelengths for each measurement spot corresponding to a sensor.

Local data is collected for a zone and this local data is normalised. Normalisation can be done, for example, by using data from another zone, including a zone corresponding to the whole of a banknote. This can be considered as a type of data pre-processing.

Data for a banknote is derived using local normalised data for a zone or zones and absolute data, such as data for the whole banknote or the zone used for normalisation.

In this example, for measurements defined by:

$$x_{ik} | i<N, | k<K$$

where N is the total number of measurement spots and K is the number of wavelengths, for a given zone Z, with a number of spots M, the local normalized data for the wavelength k is computed by:

$$z_k = \frac{\frac{1}{M}\sum_{j=1}^{M} x_{jk}}{g_k} \quad 1 < k < K \tag{1}$$

$$\text{where } g_k = \frac{1}{N}\sum_{i=1}^{N} x_{ik} \tag{2}$$

so that $g_k$ represents absolute data.

The local normalised data and the absolute data is combined to form a data vector X for the zone.

Thus, for instance for one zone measured at 3 wavelengths the vector of the data is: $(z_1, z_2, z_3, g_1, g_2, g_3)^t$.

The Mahalanobis distance uses the covariance matrix and the mean for a given denomination. It gives the distance of a fed banknote using the statistics designed from the statistical model of set of sample data analysed, for example, in the laboratory, as mentioned in the introduction.

In more detail, where $\Sigma$ and $\mu$ are the covariance matrix and the mean vector of the sample data, the Mahalanobis distance of a given input vector $x=(x_1, \ldots, x_n)$, corresponding to a fed banknote, is given by:

$$\text{mahdist}(x)=(x-\mu)^t\Sigma^{-1}(x-\mu) \tag{3}$$

Where the notation $x^t$ means the transpose of the vector x.

The calculation of the mahalanobis distance using the above formula involves the use of data based on absolute measurements of samples. However, as mentioned above, the absolute measurements are validator dependent. The present embodiment transforms the data of the fed banknote to reduce the effects of the validator of the measurements. This is done using characteristics of distributions.

If X is the vector of the data, it can be expressed in two parts X1 for local normalized data and X2 for absolute data:

$$X = \begin{pmatrix} X1 \\ X2 \end{pmatrix}.$$

The covariance matrix of X can be written with four blocks $$\begin{pmatrix} \sum_{11} & \sum_{12} \\ \sum_{21} & \sum_{22} \end{pmatrix}.$$

Let us denote by $$\begin{pmatrix} \mu_1 \\ \mu_2 \end{pmatrix}$$

the mean of X. Generally X1 and X2 are not independent and so the Mahalanobis distance of X is not equivalent to a sum of the Mahalanobis distances of X1 and X2.

It has been shown that, for a multinormal distribution $$X = \begin{pmatrix} X1 \\ X2 \end{pmatrix}$$

the components of the following vector are independent:

$$Y = \begin{pmatrix} X1 \\ X2 - \sum_{21}\sum_{11}^{-1} X1 \end{pmatrix} = \begin{pmatrix} Y1 \\ Y2 \end{pmatrix} \tag{6}$$

This involves the use of a theorem [Saporta 1990] which states that the law of the conditional variable X2/X1 has a multinormal distribution with a mean and covariance equal to:

$$E(X2/X1)=\mu_2-\Sigma_{21}\Sigma_{11}^{-1}(X1-\mu_1) \tag{4}$$

$$\text{cov}(X2/X1)=\Sigma_{22}-\Sigma_{21}\Sigma_{11}^{-1}\Sigma_{12} \tag{5}$$

The mean and the covariance matrix of Y are given by:

$$\text{mean}(Y) = \begin{pmatrix} \mu_1 \\ \mu_2 - \sum_{21}\sum_{11}^{-1}\mu_1 \end{pmatrix} \tag{7}$$

$$cov(Y) = \begin{pmatrix} \sum_{11} & 0 \\ 0 & \sum_{22} - \sum_{21}\sum_{11}^{-1}\sum_{12} \end{pmatrix} = \begin{pmatrix} \sum_{Y1} & 0 \\ 0 & \sum_{Y2} \end{pmatrix} \tag{8}$$

It can then also be shown that:

$$mahdist(X)=mahdist(Y)=mahdist(Y1)+mahdist(Y2)$$

Therefore using this transformation we can split the computation of the Mahalanobis distance into two parts which amongst other things involves processing of small matrices.

According to the definition of Y, Y1 is based on local normalised data, whereas Y2 involves absolute data, which is validator dependent.

In use in a validator, the contribution of the absolute values (mahdist (Y2)) is weighted with a small weight q ($0<q<1$ for instance $q=0.5$) at the beginning of the life of the product and q is increased later on after updating the absolute data using measurements derived from the validator in use.

$$mahdist(X)=mahdist(Y1)+q*mahdist(Y2) \tag{9}$$

In operation, in validation, the mahalanobis distance is compared to a threshold. The threshold can be predefined and fixed or made variable in time in conjunction with q for example. A possibility is to choose the fixed threshold value according to the desired final value.

The principles described above are used in programming a validator.

Samples of banknotes of each denomination are tested in validators in the laboratory according to known statistical procedures to derive values for the mean and covariances matrix for X, using a predetermined zone or zones and normalising factors for each target denomination. In the validator, the mahalanobis distance is to be calculated according to the equation (9) above, that is, using the mean and covariance matrix of Y, using X data transformed according to equation (6). Thus, the mean and covariance matrix for Y and the transform are calculated using the equations above from the measured values for X, and these values are stored in a memory in the validator.

In the present example, 4 zones are used for a given denomination, and six wavelengths, as discussed above.

Thus, X1 has 24 variables and X2 has 6 variables, the covariance matrix is size 30×30 and can be decomposed in blocks $$\begin{pmatrix} \sum_{11} & \sum_{12} \\ \sum_{21} & \sum_{22} \end{pmatrix}$$

with a size $$\begin{pmatrix} 24\times 24 & 24\times 6 \\ 6\times 24 & 6\times 6 \end{pmatrix}.$$

For the data transformation, the matrix $\Sigma_{21}\Sigma_{11}^{-1}$ with a size of 6×24 is needed. For the computation of the Mahalanobis distances of Y1 and Y2, the mean vector mean $$(Y) = \begin{pmatrix} \text{mean } (Y1) \\ \text{mean } (Y2) \end{pmatrix}$$

is required and the inverse of the covariance matrices of Y1 and Y2. For Y1, this matrix is $$\sum_{Y_1}^{-1} = \sum_{11}^{-1}$$

with a size 24×24 and for Y2 it's $\Sigma_{Y_2}^{-1}=(\Sigma_{22}-\Sigma_{21}\Sigma_{11}^{-1}\Sigma_{12})^{-1}$ with a size 6×6.

This data is loaded into the memory of the validator product, for example, in the factory. In summary, 3 matrices of size 24×24, 6×6 and 6×24 and two vectors of means with a size 24 and 6 are stored. A preliminary value for q is also stored.

In operation, a banknote is fed to the validator and measurements of the banknote are taken from the sensor and used to derive X. The X vector is transformed according to equation (6) and the mahalanobis distance is calculated using equation (9). The value of the mahalanobis distance is compared with a threshold mahT. If the value of the mahalanobis distance is less than or equal to the threshold, the banknote is accepted as a genuine example. If the value is greater than the threshold, the banknote is rejected as a forgery.

The threshold is determined in the laboratory using known techniques and programmed into the validator in the factory or in the field. For example, the threshold can be computed empirically or experimentally or based on results of simulations using statistical models. The threshold can be varied depending on the desired percentage of genuine bills it is desired to accept. For example, the threshold can be set so that a certain percentage, say 99%, of genuine banknotes are accepted, based on the statistical analysis of known banknotes.

The threshold values can be calculated, for example, using the Hotelling test for a Hotelling distribution. Although Y=Y1+q×Y2 is not a Hotelling distribution, the Hotelling threshold can be approximated by numerically approximating the distribution of Y.

In the embodiment X1 and X2 are described as local normalised data and absolute data. However, the invention is not limited to this. In general terms, the mahalanobis calculation is split into a mahalanobis calculation on subsets of data, which are essentially independent. The subsets of data can correspond to various types of data. The embodiment takes advantage of the mahalanobis in parts to weight the part of the mahalanobis calculation which is validator dependent. Another example of using the mahalanobis in parts calculation based on sets or subsets of data is described below.

Suppose a currency validator is set up to operate using a data vector X1. It may become desirable to use other data values, X2, for example, relating to another zone on a banknote. However, the validator is not initially tuned to the measurements X2. Using the principles set out above, the mahalanobis distance of X=(X1, X2) can be expressed as mahdist(X)=mahdist(Y1)+q *mahdist(Y2), where Y1=X1 and Y2 is a transform of X1 and X2 as set out above, and q can be increased as the validator is tuned to the new data, that is, the values of X2. Similarly, suppose a validator operates initially on a data vector X=(X1, X2) and at some point it becomes desirable to replace it by a data vector X'=(X1, X3). The mahalanobis distance of X' can be expressed as mahdist (X)=mahdist(Y1)+q*mahdist(Y2), where Y1=X1 and Y2 depends on X3. Thus, Y2 is weighted by q because it depends on measurements X3 and the validator is not initially tuned to X3.

For example, the above approach could be used if a new useful feature of a banknote appears or is discovered later, or to replace a feature by another known feature.

Generally speaking, the approach can be used to switch from one feature to another while keeping base features, that is statistically adapted unchanged variables that are adapted to the validator.

This could be expressed in general terms, for example, as defining a set of features and their mahalanobis distance in parts, using a subset of features for some time and substituting at least one feature of the subset by another one of the original full set, or by a new feature not in the original full set. Similarly, features could be simply added or removed from the mahalanobis calculation. In each case, the component of mahalanobis calculation based on features that are adapted to the validator are preferably retained.

The above embodiment is a reflective system, that is, light is sensed after reflection from the surface of the banknote. The invention is also applicable to other systems such as a transmissive system, where light is sensed after transmission through a banknote. The sensing system is not limited to a one-dimensional linear array of light sources and detectors, and other sensing systems can be used, such as two-dimensional arrays of sources and detectors corresponding to the whole or a part of a banknote.

The embodiment operates using specific regions of banknotes. The regions can be identified in various ways such as by using position or edge sensors, or by counting pixels.

The invention has been described in the context of a banknote validator but it is also applicable to coin validators. The sensors used in coin validators are different from those in banknote validators, but can be arranged to derive a plurality of local and global measurements from a coin, which can then be processed as described above.

In this specification, the term "light" is not limited to visible light, but covers the electromagnetic spectrum. The term currency covers, for example, banknotes, bills, coins, value sheets or coupons, cards and the like, genuine or counterfeit, and other items such as tokens, slugs and washers, all of which might be used in a currency handling apparatus.

In the embodiment, the weighting factor q is varied over the life of the product. This is especially useful when a validator is modified according to measurements derived from banknotes which are accepted as valid examples. Briefly, the data stored in the validator about a given target denomination, which is representative of the distribution as explained above, can be updated using the actual values derived from banknotes measured in the field. Clearly, the actual measurements derived by the specific validator are validator dependent, and by using them to update the data derived in the laboratory compensates for validator variations, and tunes the data to the specific validator. Accordingly, the absolute data becomes more reliable and so the weighting factor q, which weights a contribution to mahalanobis distance from absolute data, can be increased. Similarly, the weighting factor may be decreased. The weighting factor q may be varied, for example, according to time, or number of currency items measured, such as accepted and/or rejected, or number of data adaptations from measured currency items or according to other factors. If q is varied accordingly to number of currently items, this number may be for each target denomination, genuine or fake, or a total value, ie irrespective of denomination.

The threshold used in validation or denomination may be fixed, or it may be varied, over time, number of operations, number of measured banknotes for example, if the data stored in the validator is updated according to measured banknotes. The threshold may be set on the basis of the original distribution of X. Alternatively, the threshold may be set taking the original value of q into account, and the threshold may vary in use with q. The threshold value, including the original threshold value, may also be determined in the field.

Figure 4:
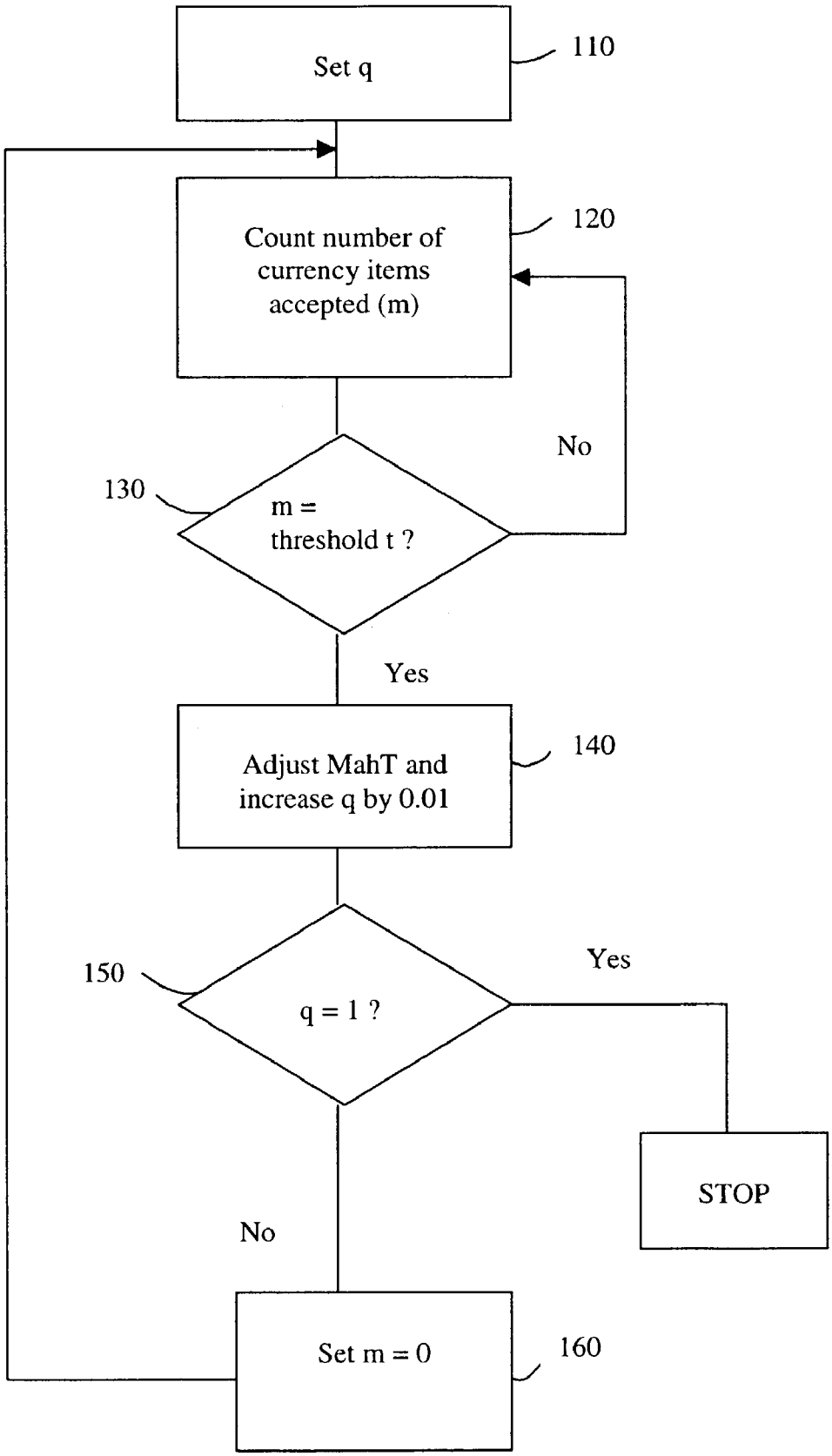
FIG. 4 is a flow chart illustrating adjusting the weighting factor q in a mahalanobis in parts calculation.

FIG. 4 is a flow chart illustrating adjustment of q and the associated threshold mahT.

In step 110, the weighting factor q is set to its initial value, say 0.5. In the illustrated example, the number of currency items accepted of each denomination in operation is counted, as variable m. The validator memory includes a threshold t. Each time a currency item of the specific denomination is accepted, m is compared with t (step 130). When m=t, the acceptance threshold mahT is adjusted and q is increased by 0.01 (step 140), reflecting the fact that the validator has been adapted slightly to the validator measurements, by incorporating measurements of accepted banknotes. MahT is adjusted according to known techniques for updating acceptance thresholds using measured values in the field on a specific validator. In outline, the validator stores a model of the population distribution as derived in the laboratory and used to derive the original acceptance threshold. This model and threshold is then adjusted by modifying the original population threshold to include the actual measured values of the currency items accepted in the field.

Next q is compared with 1 (step 150). If q is less than 1, m is set to 0 and counting of accepted currency items begins again (step 160). If q is equal to 1, it cannot go higher, so adjustment of q and the corresponding acceptance threshold is stopped, and the validator is adapted.

The threshold t is variable, and affects the speed of the adaptation of q and mahT.

The above steps may be done for each target denomination in parallel, or they may be done for only some of the target denominations. Different threshold values t may be used for different denominations, Similarly, target denominations may include known fake examples of accepted denominations, in which case q and mahT may be adjusted in a similar manner, for example, by counting the number of currency items rejected as examples of the known fakes.

In the embodiment, the mahalanobis calculation is split into two independent parts. However, similarly, the calculation can be split into more parts. For example, the components of vector Y1 or Y2 can be split, or sub-divided, into independent parts, and the mahalanobis calculation done as the sum of more than two independent mahalanobis distances.

In the embodiment described above, mahalanobis distance is used to validate a given banknote. However, mahalanobis distance can also be used to denominate a banknote, that is, to determine which target denomination or denominations a fed banknote is likely to belong to, without actually determining if the banknote is a valid example of that denomination or denominations. A denomination test can, for example, be followed by a stricter validation test, which may use mahalanobis distance or another validation test.

In the embodiment described above, the sets of components of the data vector are local data and absolute data, and as a result of the data transformation, the contribution of the absolute data can be weighted.. As an alternative, the original data vector could be made up of different sets of data components, such as data from different zones of a banknote which are combined to form the original data vector, and the contribution of data from one zone is weighted, perhaps progressively.

What is claimed is:

1. A method of classifying an item of currency using a currency tester, the method comprising sensing variable characteristics of a currency item and deriving a data vector (X) using values of the sensed characteristics, and transforming the data vector so that the variables represented by at least first and second sets of components (Y1, Y2) of the transformed vector are substantially independent, so that the mahalanobis distance of X is substantially equivalent to the sum of the mahalanobis distances of the components (Y1, Y2), and calculating a mahalanobis distance in at least two parts using said first and second sets of components.

2. A method of classifying an item of currency using a currency tester, the method comprising performing a mahalanobis distance calculation using data derived from sensing characteristics of the currency item, wherein the mahalanobis distance calculation is performed in at least two parts which are substantially independent so that for a data vector X having components Y1 and Y2, X=(Y1, Y2), then the mahalanobis distance of X is substantially equal to the mahalanobis distance of Y1 plus the mahalanobis distance of Y2.

3. A method as claimed in claim 1 or claim 2 wherein at least one of said parts is weighted by a weighting value.

4. A method of operating a currency tester comprising calculating a mahalanobis distance for classifying an item of currency using measured features of the currency item by computing the mahalanobis distance in parts using a method as claimed in claim 3, wherein initially the mahalanobis distance in parts computed using data corresponding to a first set of features of the currency item, and subsequently the mahalanobis distance in parts is computed using data corresponding to a second set of features of the currency item.

5. A method of classifying an item of currency using a currency tester, the method comprising performing a mahalanobis distance calculation using data derived from sensing characteristics of the currency item, wherein the mahalanobis distance calculation is performed in at least two parts, wherein at least one part is weighted by a weighting value.

6. A method as claimed in claim 5 comprising varying the weighting value.

7. A method as claimed in claim 6 comprising monotonically increasing or decreasing the weighting value.

8. A method as claimed in claim 6 comprising varying the weighting value between 0 and 1.

9. A method as claimed in claim 6 wherein the weighting value is varied according to one or more of time, the number of currency items tested, the number of currency items accepted and the number of currency items rejected, either in total or for a specific target denomination of currency.

10. A method as claimed in claim 5 comprising sensing a currency item using one or more sensors to produce sensor values and deriving a data vector comprising a plurality of components.

11. A method as claimed in claim 4 wherein at least one of said parts includes normalised data and at least one of said parts involves absolute data.

12. A method as claimed in claim 5 wherein at least one of said parts relates to a first feature of a currency item and at least another of said parts relates to another feature of a currency item.

13. A method as claimed in claim 5 comprising comparing the resulting mahalanobis distance with a fixed or variable threshold.

14. A method as claimed in claim 13 wherein the threshold is varied according to one or more of time, the number of currency items tested, the number of currency items accepted and the number of currency items rejected, either in total or for a specific target denomination of currency.

15. A method as claimed in claim 6 comprising comparing the resulting mahalanobis distance with a variable threshold wherein the variation in the threshold is related to the variation in the weighting value.

16. A method as claimed in claim 13 where the threshold is calculated using a Hotelling test.

17. A method as claimed in claim 5 comprising increasing or decreasing the dimensions of the mahalanobis calculation.

18. A method as claimed in claim 5 for validating and/or denominating a currency item.

19. A method of operating a currency tester comprising calculating a mahalanobis distance for classifying an item of currency using measured features of the currency item by computing the mahalanobis distance in parts using a method as claimed in any one of claims 1, 2, or 5 through 18, wherein initially the mahalanobis distance in parts is computed using data corresponding to a first set of features of the currency item, and subsequently the mahalanobis distance in parts is computed using data corresponding to a second set of features of the currency item.

20. A method as claimed in claim 19 wherein the first and second set of features overlap.

21. A method as claimed in claim 20 wherein the common features are features that are adapted to the currency tester.

22. A method as claimed in claim 19 wherein the second set is derived from the first set by either adding one or more features, removing one or more features or substituting one or more features.

23. A method of programming a currency tester comprising storing data for executing a method as claimed in claim 19 in a currency tester.

24. A method as claimed in claim 23 comprising deriving an acceptance threshold for a currency item using a Hotelling test.

25. A currency tester comprising means for executing a method as claimed in claim 18.

26. A currency tester comprising means for executing a method as claimed in any one of claims 1, 2, or 5.

27. A currency tester as claimed in claim 26 comprising one or more sensors for sensing characteristics of currency items, data processing means and data storage means.

28. A currency tester as claimed in claims 26 comprising a banknote tester.

29. A currenct tester as claimed in claim 26 comprising a coin tester.

* * * * *

UNITED STATES PATENT AND TRADEMARK OFFICE

CERTIFICATE OF CORRECTION

PATENT NO. : 7,000,754 B2
APPLICATION NO. : 10/441809
DATED : February 2, 2006
INVENTOR(S) : Gaston Baudat and Fatiha Anouar It is certified that error appears in the above-identified patent and that said Letters Patent is hereby corrected as shown below:

Col. 11, Claim 11, line 34, “4”should be --5--.

Col. 11, Claim 11, line 35, “normalised” should be --normalized--.

Col. 12, Claim 25, line 37, “18” should be --19--.

Signed and Sealed this

Nineteenth Day of December, 2006

JON W. DUDAS
*Director of the United States Patent and Trademark Office*

UNITED STATES PATENT AND TRADEMARK OFFICE

CERTIFICATE OF CORRECTION

PATENT NO. : 7,000,754 B2
APPLICATION NO. : 10/441809
DATED : February 21, 2006
INVENTOR(S) : Gaston Baudat and Fatiha Anouar It is certified that error appears in the above-identified patent and that said Letters Patent is hereby corrected as shown below:

Col. 11, Claim 11, line 34, “4”should be --5--.

Col. 11, Claim 11, line 35, “normalised” should be --normalized--.

Col. 12, Claim 25, line 37, “18” should be --19--.

This certificate supersedes Certificate of Correction issued December 19, 2006.

Signed and Sealed this

Thirtieth Day of January, 2007

JON W. DUDAS
*Director of the United States Patent and Trademark Office*